US011293253B2

(12) United States Patent
Santoso et al.

(10) Patent No.: US 11,293,253 B2
(45) Date of Patent: Apr. 5, 2022

(54) DUAL SUB-SURFACE RELEASE PLUG WITH BYPASS FOR SMALL DIAMETER LINERS

(71) Applicant: Halliburton Energy Services, Inc., Houston, TX (US)

(72) Inventors: Handoko Tirto Santoso, Houston, TX (US); Lonnie Carl Helms, Humble, TX (US); Tor Sigve Saetre, Spring, TX (US); Frank Vinicia Acosta, Spring, TX (US); Thomas Zachary Vonk, Houston, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 49 days.

(21) Appl. No.: 16/848,037

(22) Filed: Apr. 14, 2020

(65) Prior Publication Data

US 2021/0317721 A1 Oct. 14, 2021

(51) Int. Cl.

| | |
|---|---|
| ***E21B 33/12*** | (2006.01) |
| ***E21B 33/124*** | (2006.01) |
| ***E21B 33/14*** | (2006.01) |
| *E21B 33/129* | (2006.01) |

(52) U.S. Cl.

CPC ..... *E21B 33/1208* (2013.01); *E21B 33/124* (2013.01); *E21B 33/14* (2013.01); *E21B 33/1294* (2013.01)

(58) Field of Classification Search

CPC ..... E21B 33/1208; E21B 33/124

See application file for complete search history.

(56) References Cited

U.S. PATENT DOCUMENTS

| | | | |
|---|---|---|---|
| 5,762,139 | A | 6/1998 | Sullaway et al. |
| 6,571,880 | B1 | 6/2003 | Butterfield, Jr. et al. |
| 8,201,634 | B2 | 6/2012 | Laurel et al. |
| 9,200,499 | B2 | 12/2015 | Hall et al. |
| 2014/0224505 | A1 | 8/2014 | Ramon |
| 2014/0345852 | A1 | 11/2014 | Hall et al. |
| 2015/0330181 | A1 | 11/2015 | Budde et al. |

OTHER PUBLICATIONS

International Search Report and Written Opinion issued in related PCT Application No. PCT/US2020/028551 dated Jan. 7, 2021, 13 pages.

*Primary Examiner* — Catherine Loikith

(74) *Attorney, Agent, or Firm* — John Wustenberg; Baker Botts L.L.P.

(57) ABSTRACT

A dual plug system comprises a bottom plug and a top plug. The bottom plug comprises, a bottom plug mandrel, a plurality of first fins, and a first seat. The plurality of first fins is disposed between a first end and a second end of the bottom plug mandrel, and the first seat is disposed at the second end The top plug comprises a first end and a second end. The top plug further comprises a top plug mandrel, a plurality of second fins, a collar, and a sleeve. The plurality of second fins is disposed around the top plug mandrel covering at least a portion of the length of the top plug mandrel, and the collar is coupled to the top plug mandrel The dual plug system further comprises a connector, wherein the connector is coupled to the first end of the top plug.

20 Claims, 5 Drawing Sheets

DUAL SUB-SURFACE RELEASE PLUG WITH BYPASS FOR SMALL DIAMETER LINERS

TECHNICAL FIELD OF THE INVENTION

The present disclosure relates generally to cementing operations and, more particularly, to systems and methods using a dual plug system with selectively releasable darts.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve several different steps, for example, drilling a wellbore at a desired well site, treating the wellbore to optimize production of hydrocarbons, performing the necessary steps to produce the hydrocarbons from the subterranean formation, and pumping the hydrocarbons to the surface of the earth.

In the drilling of deep wells, it is often desirable to cement a liner in the well bore in separate stages, beginning at the bottom of the well and working upward. To stabilize the liner, a cement slurry is often pumped downwardly through the liner, and then upwardly into the annulus between the liner and the walls of the wellbore. One concern in this process is that, prior to the introduction of the cement slurry into the liner, the liner generally contains a drilling or some other servicing fluid that may contaminate the cement slurry. To prevent this contamination, a subterranean plug, often referred to as a cementing plug or a "bottom" plug, may be placed into the liner ahead of the cement slurry as a boundary between the two. The plug may perform other functions as well, such as wiping fluid from the inner surface of the liner as it travels through the liner, which may further reduce the risk of contamination.

Similarly, after the desired quantity of cement slurry is placed into the liner, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the liner as the displacement fluid is pumped downwardly into the liner.

Such cementing plugs may be selectively released at desired times during the cementing process. Additionally, a check valve, typically called a float valve, will be installed to perform the first stage operation. The float valve may permit the flow of fluids through the bottom of the liner into the annulus, but not the reverse. A cementing plug will not pass through the float valve.

In conventional operations, the cement slurry will flow through the central bore of the tubulars (i.e., liners) and equipment. However, for smaller diameter tubulars, there is not enough clearance to allow for central bore flow as the downhole equipment and tooling takes up most of the space within the interior of the tubulars.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection or a shaft coupling via other devices and connections.

Figure 1:
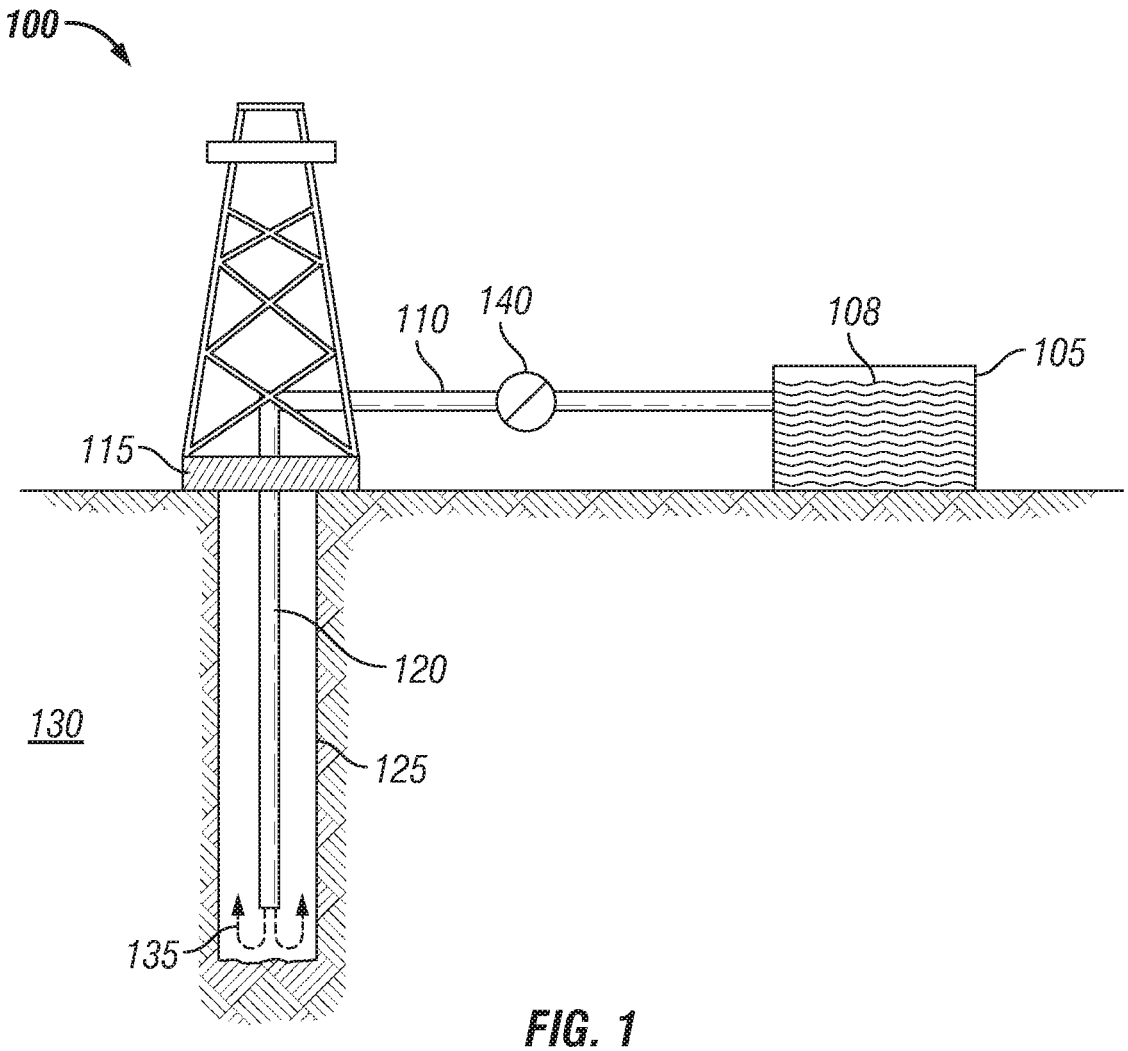
FIG. 1 is a system configured for delivering cement slurries downhole, according to one or more aspects of the present disclosure.

FIG. 1 shows an illustrative schematic of a system 100 that can deliver cement slurries, according to one or more embodiments. While system 100 is illustrated as being disposed at a land-based subterranean environment, the present disclosure contemplates any suitable environment including a subsea environment. In one or more embodiments, any one or more components or elements may be used with subterranean operations equipment located on offshore platforms, drill ships, semi-submersibles, drilling barges and land-based rigs. As depicted in FIG. 1, the system 100 may include a mixing tank 105, in which a cement slurry 108 may be formulated. Again, in one or more embodiments, the mixing tank 105 may represent, or otherwise be replaced with, a transport vehicle, a shipping container or both configured to deliver or otherwise convey the cement slurry 108 to the well site. The cement slurry 108 may be conveyed via a line 110 to a wellhead 115, where the cement slurry 108 enters a tubular 120 (for example, a liner, a casing, drill pipe, production tubing, coiled tubing, etc.). The tubular 120 may extend from the wellhead 115 into a wellbore 125 penetrating a subterranean formation 130. In one or more embodiments, the wellbore 125 may be cased and comprise a casing or may be open. Upon being ejected from the tubular 120, the cement slurry 108 may subsequently return up the wellbore 125 in the annulus between the tubular 120 and the wellbore 125 as indicated by flow lines 135. A pump 140 may be configured to raise the pressure of the cement slurry 108 to a desired degree before introduction of the cement slurry 108 into tubular 120 (or the annulus). It is to be recognized that the system 100 is merely exemplary in nature and various additional components may be present that have not necessarily been depicted in FIG. 1 in the interest of clarity. Non-limiting additional components that may be present include, but are not limited to, supply hoppers, valves, condensers, adapters, joints, gauges, sensors, compressors, pressure controllers, pressure sensors, flow rate controllers, flow rate sensors, temperature sensors, and the like.

One skilled in the art, with the benefit of this disclosure, may recognize the changes to the system 100 described in FIG. 1 to provide for other cementing operations (for example, squeeze operations and the like).

It is also to be recognized that the cement slurry 108 may also directly, indirectly or both affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (for example, shoes, collars, valves, etc.), wellbore projectiles (for example, wipers, plugs, darts, balls, etc.), logging tools and related telemetry equipment, actuators (for example, electromechanical devices, hydromechanical devices, etc.), sliding sleeves, production sleeves, plugs, screens, filters, flow control devices (for example, inflow control devices, autonomous inflow control devices, outflow control devices, etc.), couplings (for example, electro-hydraulic wet connect, dry connect, inductive coupler, etc.), control lines (for example, electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 1.

Figure 2:
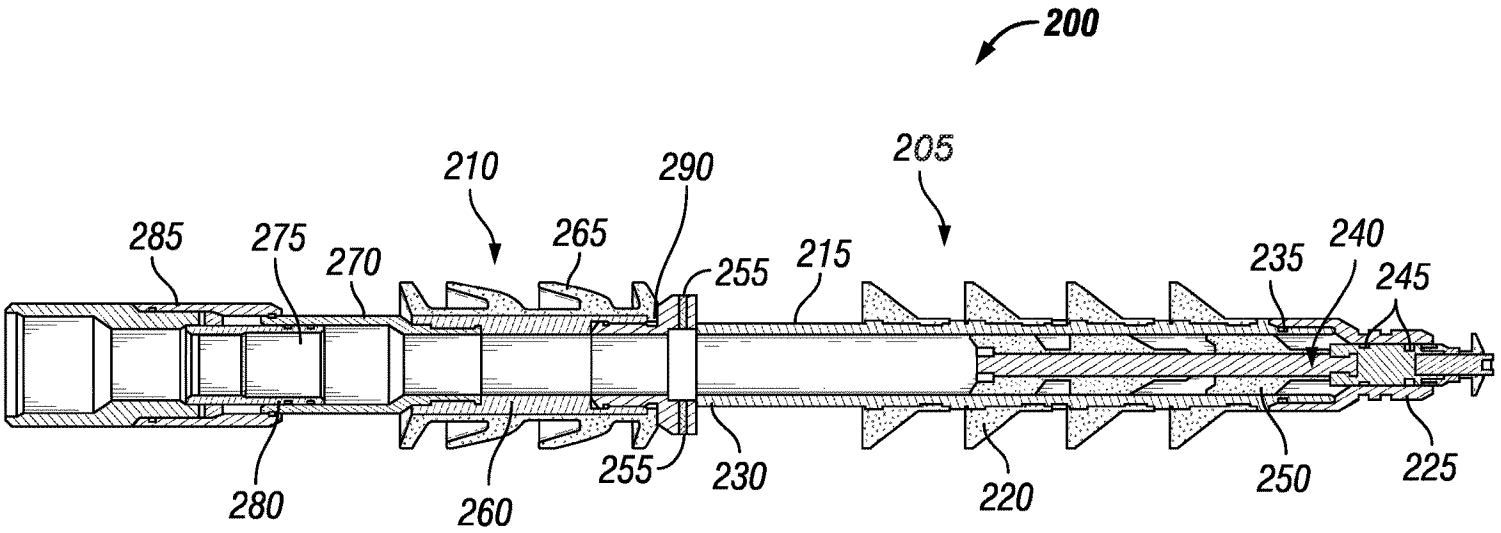
FIG. 2 is a cross-sectional view of an illustrative dual plug system, according to one or more aspects of the present disclosure.

FIG. 2 is an illustrative dual plug system 200, according to one or more aspects of the present disclosure. The dual plug system 200 may be configured to selectively release two plugs in small diameter liners. In embodiments, small diameter liners may have a diameter less than about 5.5 inches. Without limitations, small diameter liners may have a diameter of about 1 inch to about 5.5 inches, about 3 inches to about 5.5 inches, and about 4 inches to about 5.5 inches. In other embodiments, the dual plug system 200 may be utilized in liners comprising a diameter of less than about 7⅝ inches. As illustrated, the dual plug system 200 may comprise a bottom plug 205 and a top plug 210. The bottom plug 205 may comprise a bottom plug mandrel 215, a plurality of first fins 220, and a first seat 225. In one or more embodiments, the bottom plug mandrel 215 may be any suitable size, height, shape, and combinations thereof. Without limitations, the bottom plug mandrel 215 may by cylindrical and have a circular cross-section. In embodiments, a first end 230 of the bottom plug mandrel 215 may be coupled to the top plug 210. Without limitations, the bottom plug mandrel 215 may be coupled to the top plug 210 by any suitable means, including shear pins. As illustrated, the first seat 225 may be disposed at a second end 235 of the bottom plug mandrel 215, wherein the second end 235 is opposite to the first end 230. The first seat 225 may be configured to receive a first dart 240, wherein the first dart 240 is released from a surface location and lands within the first seat 225 to dislodge the bottom plug 205 from the top plug 210. In embodiments, the first dart 240 may seal against the interior of the bottom plug 205 through the use of O-rings 245, a plurality of first dart fins 250, and combinations thereof. As the first dart 240 travels through the bottom plug 205 and lands in the first seat 225, the plurality of first dart fins 250 may remove material present within or disposed along the interior of the bottom plug 205. In one or more embodiments, the plurality of first dart fins 250 may force any material out of the first seat 225 and create a seal against the interior of the bottom plug 205.

Without limitations, the first seat 225 may be coupled to the bottom plug mandrel 215 at the second end 235 by any suitable means, including fasteners, threading, adhesives, welding, press-fit, and combinations thereof. In one or more embodiments, the plurality of first fins 220 may be disposed around the bottom plug mandrel 215 in between the first end 230 and the second end 235. The plurality of first fins 220 may be configured to remove material from an interior of a tubular as the bottom plug 205 traverses downhole. Without limitations, there may be any suitable number of the plurality of first fins 220. The plurality of first fins 220 may be any suitable size, height, shape, and combinations thereof. In embodiments, the plurality of first fins 220 may comprise any suitable materials, such as rubbers, polymers, elastomers, and combinations thereof.

As previously described, the bottom plug 205 may be coupled to the top plug 210 via one or more shear pins 255. The top plug 210 may comprise a top plug mandrel 260, a plurality of second fins 265, a collar 270, and a sleeve 275. In one or more embodiments, the top plug mandrel 260 may be any suitable size, height, shape, and combinations thereof. Without limitations, the top plug mandrel 260 may by cylindrical and have a circular cross-section. In embodiments, a first end 280 of the top plug 210 may be coupled to a connector 285. Without limitations, the top plug 210 may be coupled to the connector 285 by any suitable means, including fasteners, threading, adhesives, welding, press-fit, and combinations thereof. In embodiments, the connector 285 may be coupled to an end of the tubular 120 (referring to FIG. 1) opposite from the top plug 210. In one or more embodiments, a second end 290 of the top plug 210 may be coupled to the bottom plug 205 via the one or more shear pins 255.

As illustrated, the plurality of second fins 265 may be disposed around the top plug mandrel 260 covering at least a portion of the length of the top plug mandrel 260 between the first end 280 and the second end 290. In embodiments, the plurality of second fins 265 may be configured to remove material from an interior of a tubular as the top plug 210 traverses downhole. Without limitations, there may be any suitable number of the plurality of second fins 265. The plurality of second fins 265 may be any suitable size, height, shape, and combinations thereof. In embodiments, the plurality of second fins 265 may comprise any suitable materials, such as rubbers, polymers, elastomers, and combinations thereof.

In one or more embodiments, the collar 270 may be coupled to the top plug mandrel 260 and may be disposed between the top plug mandrel 260 and the connector 285. The collar 270 may be configured to serve as a seat for the sleeve 275. In embodiments, a second dart (for example, second dart 700 on FIG. 7) may be released from a surface location and land within the sleeve 275. In embodiments, the second dart may seal against the interior of the sleeve 275. As pressure increases, the second dart may apply force onto the sleeve 275 to translate into the collar 270. The sleeve 275 may translate and seat against the interior of the collar 270. As the pressure further increases, the sleeve 275 may apply force onto the collar 270 to dislodge the top plug 210 from the connector 285.

Figure 3:
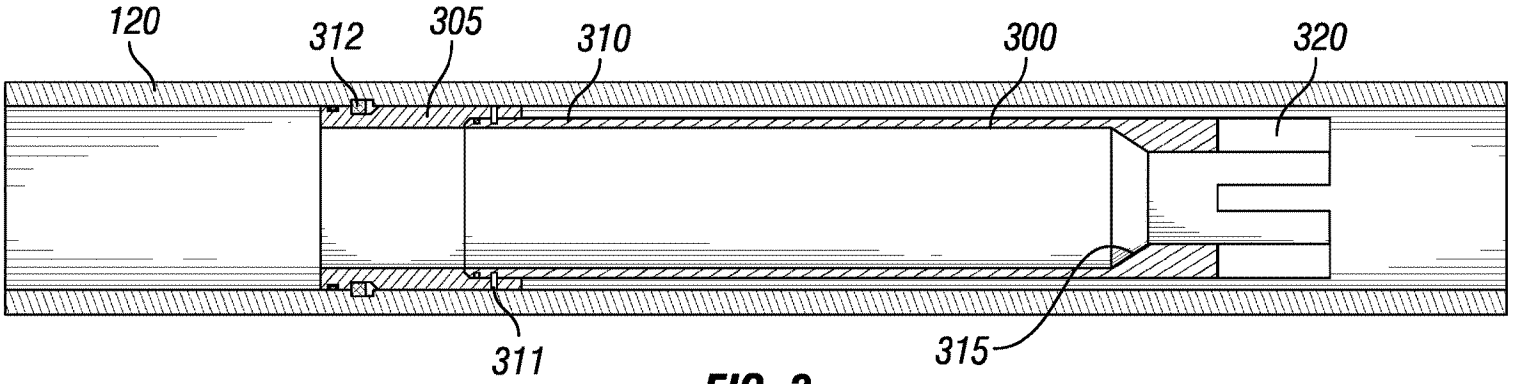
FIG. 3 is a cross-sectional view of an illustrative landing collar and landing collar sleeve, according to one or more aspects of the present disclosure.

FIG. 3 illustrates a landing collar 300 and a landing collar sleeve 305. In one or more embodiments, the landing collar 300 may be configured to receive the bottom plug 205 (referring to FIG. 2), and the landing collar sleeve 305 may be configured to receive the top plug 210 (referring to FIG. 2). In one or more embodiments, the diameter of the landing collar sleeve 305 may be greater than the diameter of the landing collar 300. The landing collar 300 may be any suitable size, height, shape, and combinations thereof. Without limitations, the landing collar 300 may by cylindrical and have a circular cross-section. In embodiments, a first end 310 of the landing collar 300 may be coupled to the landing collar sleeve 305. Without limitations, the landing collar 300 may be coupled to the landing collar sleeve 305 by any suitable means, including shear pins. In embodiments, one or more shear pins 311 may couple the landing collar 300 to the landing collar sleeve 305. In further embodiments a lock ring 312 may couple the landing collar sleeve 305 to the interior of the tubular 120.

As illustrated, an internal seat 315 may be disposed at a second end 320 of the landing collar 300, wherein the second end 320 is opposite to the first end 310. The internal seat 315 may be configured to receive the bottom plug 205, wherein the bottom plug 205 may land within the internal seat 315 to dislodge the landing collar 300 from the landing collar sleeve 305. In embodiments, the bottom plug 205 may seal against the interior of the bottom plug 205 through the use of O-rings, the plurality of first fins 220 (referring to FIG. 2), and combinations thereof. As the bottom plug 205 travels through the landing collar 300 and lands in the internal seat 315, the plurality of first fins 220 may remove material present within or disposed along the interior of the landing collar 300. In one or more embodiments, the plurality of first fins 220 may force any material out of the landing collar 300 and create a seal against the interior of the landing collar 300.

Figure 4:
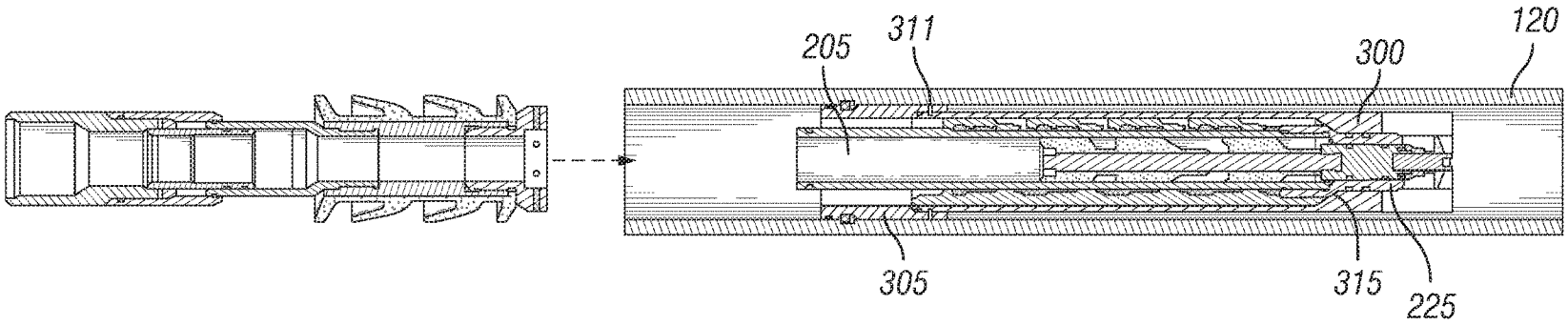
FIG. 4 is a cross-sectional view of a bottom plug landed within a landing collar, according to one or more aspects of the present disclosure.
Figure 5:
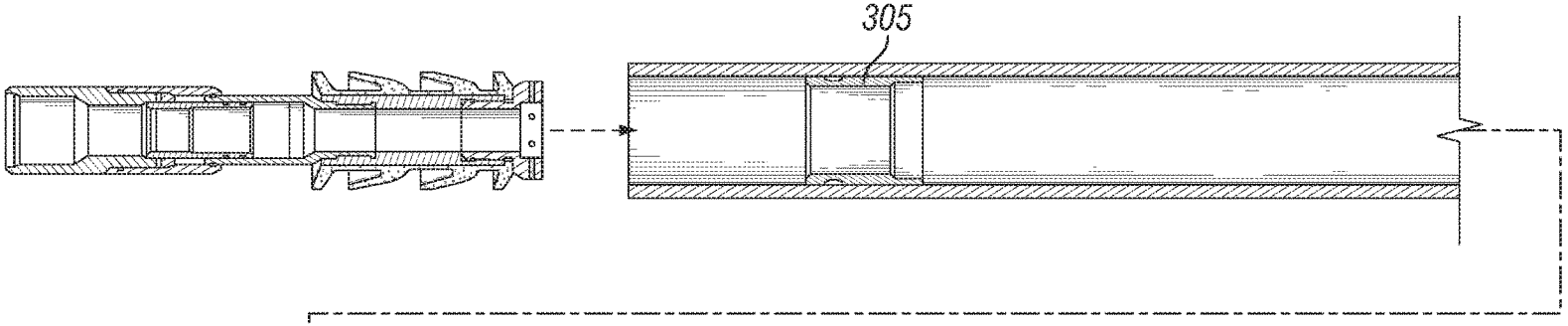
FIG. 5 is a cross-sectional view of a landing collar landed on a float collar, according to one or more aspects of the present disclosure.
Figure 5:
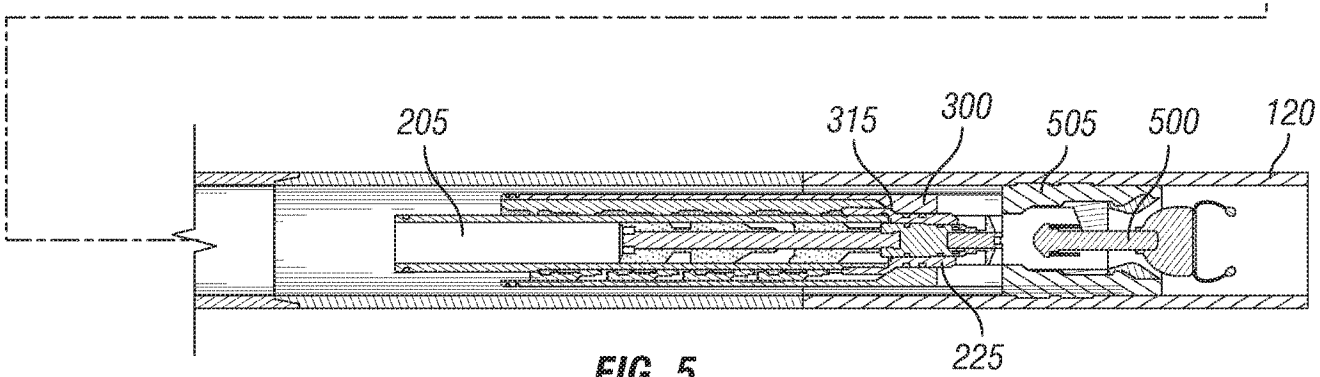
Figure 6:
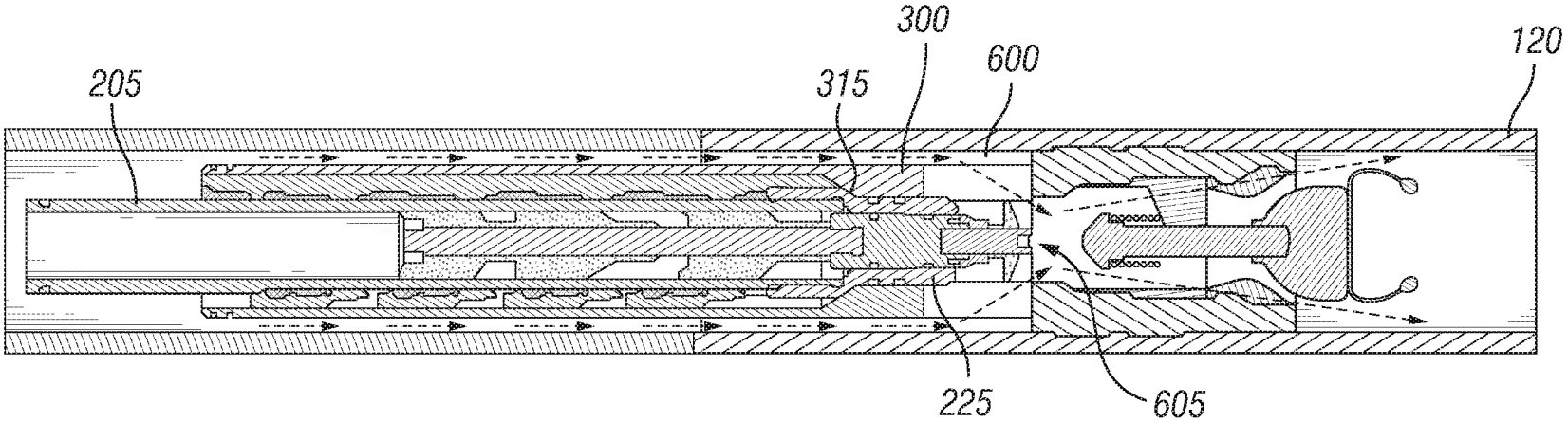
FIG. 6 is a cross-sectional view of a flow path with an open valve, according to one or more aspects of the present disclosure.

FIGS. 4-6 illustrate the process of the bottom plug 205 actuating a valve disposed downhole from the landing collar 300. FIG. 4 illustrates the bottom plug 205 seating within the landing collar 300. FIG. 5 illustrates the landing collar 300 landing on the valve. FIG. 6 illustrates the fluid flow through the valve. As illustrated, once released, the bottom plug 205 may traverse downhole and into the landing collar 300. In embodiments, the exterior of the first seat 225 may land and seat against the internal seat 315 of the landing collar 300. In one or more embodiments, pressure may increase to the point where the one or more shear pins 311 (as shown on FIG. 4) break and release the landing collar 300 from the landing collar sleeve 305. The landing collar 300 may translate downhole until encountering a valve 500 disposed within a float collar 505 (as shown on FIGS. 5-6). In one or more embodiments, the float collar 505 may be integrated into and/or coupled to the tubular 120. In embodiments, the valve 500 may permit fluid to pass downward but not upward through the tubular 120.

During operations, any suitable fluid, such as a cement slurry, may be pumped downhole as the landing collar 300 is landed against the float collar 505. In embodiments, the fluid may flow along an annulus 600 (as shown on FIG. 6) defined by the exterior of the landing collar 300 and the interior of the tubular 120. As the fluid flows along the annulus 600, it may further flow into the inlet 605 (as shown on FIG. 6) of the float collar 505. The fluid pressure may actuate the valve 500 to an open position, thereby allowing the fluid to flow out of the valve 500 and to continue to flow downhole.

Figure 7:
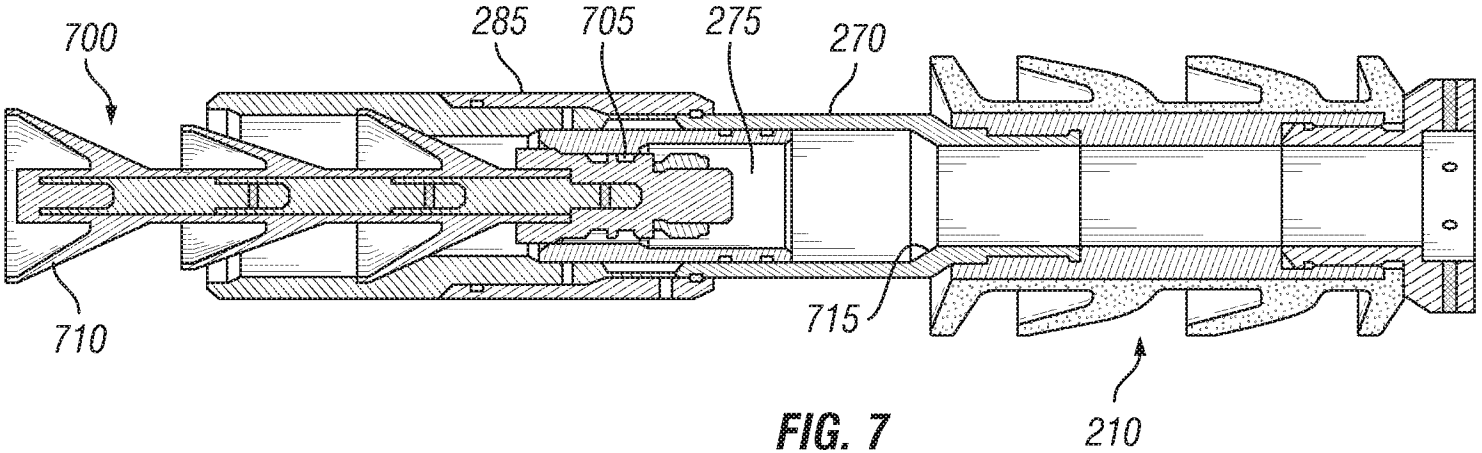
FIG. 7 is a cross-sectional view of a second dart landed within a top plug, according to one or more aspects of the present disclosure.
Figure 8:
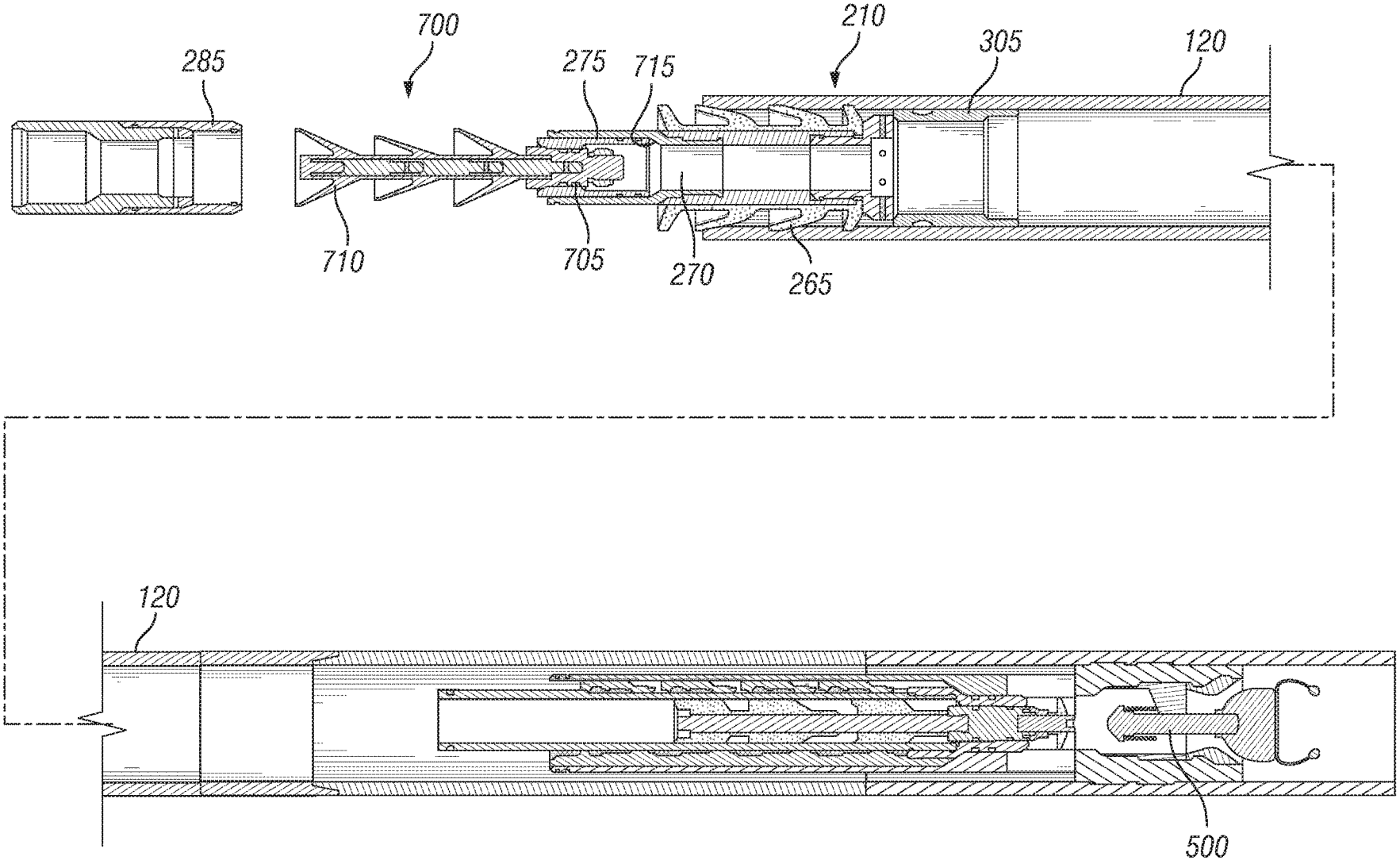
FIG. 8 is a cross-sectional view of a top plug landed on a landing collar sleeve, according to one or more aspects of the present disclosure.

FIGS. 7-8 illustrate the process of releasing the top plug 210 to inhibit the fluid pressure against the valve 500 (referring to FIG. 5) thereby closing the valve 500. FIG. 7 illustrates a second dart 700 landing within the sleeve 275 of the top plug 210. FIG. 8 illustrates the top plug 210 landing on the landing collar sleeve 305. The second dart 700 may be released from a surface location and land within the top plug 210 to dislodge the top plug 210 from the connector 285. In embodiments, the second dart 700 may seal against the interior of the sleeve 275 through the use of O-rings 705. In one or more embodiments, the second dart 700 may comprise a plurality of second dart fins 710. As the first dart 240 travels through the tubular 120 (referring to FIG. 1) and lands in the sleeve 275, the plurality of second dart fins 710 may remove material present within or disposed along the interior of the tubular 120. In one or more embodiments, the plurality of second dart fins 710 may force any material present within the tubular 120 out of the top plug 210 and create a seal against the interior of the top plug 210. During operations, the pressure may increase as the second dart 700 prevents fluid from flowing through the top plug 210. In one or more embodiments, the second dart 700 may force the sleeve 275 to translate into the collar 270. The sleeve 275 may translate and land against a collar seat 715 disposed within the collar 270. As the pressure further increases, the sleeve 275 may apply force onto the collar seat 715 to dislodge the top plug 210 from the connector 285. With reference to FIG. 8, once the top plug 210 has been uncoupled from the connector 285, the top plug may translate downhole and land onto the landing collar sleeve 305. As illustrated, the plurality of second fins 265 may seal against the interior of the tubular 120, and the second dart 700 may seal the central bore of the top plug 210 from further fluid flow. As fluid flow has been inhibited, the valve 500 may transition to a closed position, and the cementing operation may conclude. During operations, verification of the landing of any one of the bottom plug 205, top plug 210, landing collar 300, first dart 240, or second dart 700 may be at a surface location when a pressure increase is observed.

According to one or more aspects of the present disclosure, the dual plug system 200 provides an efficient and cost-effective method of operation for cementing in small diameter liners. Typically, the fluid flow occurs through the central bore, but this is not efficient in small diameter liners. By providing a bypass along the annulus 600, cementing operations may be done more effectively in small diameter liners.

An embodiment of the present disclosure is a dual plug system, comprising: a bottom plug, wherein the bottom plug comprises: a bottom plug mandrel; a plurality of first fins; and a first seat; wherein the plurality of first fins is disposed between a first end and a second end of the bottom plug mandrel, wherein the first seat is disposed at the second end; a top plug, wherein the top plug comprises a first end and a second end, wherein the top plug comprises: a top plug mandrel; a plurality of second fins; a collar; and a sleeve; wherein the plurality of second fins is disposed around the top plug mandrel covering at least a portion of the length of the top plug mandrel, wherein the collar is coupled to the top plug mandrel; and a connector, wherein the connector is coupled to the first end of the top plug.

In one or more embodiments described in the preceding paragraph, wherein the collar is disposed between the top plug mandrel and the connector. In one or more embodiments described above, wherein the collar comprises a collar seat configured to receive the sleeve. In one or more embodiments described above, wherein the connector is coupled to an end of a tubular. In one or more embodiments described above, wherein the bottom plug is coupled to the top plug through one or more shear pins. In one or more embodiments described above, further comprising a landing collar and a landing collar sleeve. In one or more embodiments described above, wherein the diameter of the landing collar sleeve is greater than the diameter of the landing collar. In one or more embodiments described above, wherein a first end of the landing collar is coupled to the landing collar sleeve through one or more shear pins. In one or more embodiments described above, wherein the landing collar comprises an internal seat disposed at a second end of the landing collar. In one or more embodiments described above, further comprising a first dart, wherein the first dart comprises O-rings and a plurality of first dart fins. In one or more embodiments described above, further comprising a second dart, wherein the second dart comprises O-rings and a plurality of second dart fins. In one or more embodiments described above, further comprising a float collar and a valve, wherein the valve is disposed within the float collar.

Another embodiment of the present disclosure is a method of operating a dual plug system, comprising: releasing a first dart from a surface location into a wellbore; landing the first dart within a bottom plug; shearing one or more shear pins coupling the bottom plug to a top plug; releasing a second dart from the surface location into the wellbore; and landing the second dart within the top plug, wherein the top plug is coupled to an end of a tubular through a connector.

In one or more embodiments described in the preceding paragraph, wherein the first dart lands on a first seat disposed at a second end of the bottom plug, wherein the first dart creates a seal in the interior of the bottom plug. In one or more embodiments described above, wherein shearing one or more shear pins coupling the bottom plug to the top plug comprises of pressurizing the tubular. In one or more embodiments described above, further comprising of landing the bottom plug in a landing collar, wherein the landing collar is coupled to a landing collar sleeve. In one or more embodiments described above, further comprising of landing the landing collar onto a float collar, wherein the float collar comprises a valve. In one or more embodiments described above, further comprising of introducing a fluid into the wellbore, wherein the fluid flows along an annulus defined by the exterior of the landing collar and the interior of the tubular, wherein the tubular has a diameter less than 5.5 inches. In one or more embodiments described above, wherein the second dart lands in a sleeve, wherein the sleeve translates and seats against a collar coupled to a top plug mandrel of the top plug, wherein the second dart creates a seal in the interior of the top plug. In one or more embodiments described above, further comprising of landing the top plug onto the landing collar sleeve, wherein a plurality of second fins creates a seal against the interior of the tubular.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A dual plug system, comprising:

a bottom plug, wherein the bottom plug comprises:

a bottom plug mandrel;

a plurality of first fins; and a first seat;

wherein the plurality of first fins is disposed between a first end and a second end of the bottom plug mandrel, wherein the first seat is disposed at the second end;

a top plug, wherein the top plug comprises a first end and a second end, wherein the top plug comprises:

a top plug mandrel;

a plurality of second fins;

a collar; and a sleeve;

wherein the plurality of second fins is disposed around the top plug mandrel covering at least a portion of a length of the top plug mandrel, wherein the collar is coupled to the top plug mandrel;

a connector, wherein the connector is coupled to the first end of the top plug; and a landing collar coupled to a landing collar sleeve, wherein a diameter of the landing collar sleeve is greater than a diameter of the landing collar, wherein the landing collar is operable to receive the bottom plug and land onto a float collar, wherein a fluid bypasses the bottom plug and the landing collar to flow into the float collar based, at least in part, on the difference between the diameter of the landing collar and the diameter of the landing collar sleeve.

2. The dual plug system of claim 1, wherein the collar is disposed between the top plug mandrel and the connector.

3. The dual plug system of claim 1, wherein the collar comprises a collar seat configured to receive the sleeve.

4. The dual plug system of claim 1, wherein the bottom plug is coupled to the top plug through one or more shear pins.

5. The dual plug system of claim 1, wherein a first end of the landing collar is coupled to the landing collar sleeve through one or more shear pins.

6. The dual plug system of claim 1, wherein the landing collar comprises an internal seat disposed at a second end of the landing collar.

7. The dual plug system of claim 1, further comprising a first dart, wherein the first dart comprises O-rings and a plurality of first dart fins.

8. The dual plug system of claim 1, further comprising a second dart, wherein the second dart comprises O-rings and a plurality of second dart fins.

9. The dual plug system of claim 1, further comprising the float collar and a valve, wherein the valve is disposed within the float collar.

10. A method of operating a dual plug system, comprising:

releasing a first dart from a surface location into a wellbore;

landing the first dart within a bottom plug;

shearing one or more shear pins coupling the bottom plug to a top plug;

introducing a fluid into the wellbore, wherein the fluid flows along an annulus defined by an exterior of a landing collar and an interior of a tubular to enter a float collar by bypassing the bottom plug and the landing collar;

releasing a second dart from the surface location into the wellbore; and landing the second dart within the top plug.

11. The method of claim 10, wherein the first dart lands on a first seat disposed at a second end of the bottom plug, wherein the first dart creates a seal in an interior of the bottom plug.

12. The method of claim 10, wherein shearing one or more shear pins coupling the bottom plug to the top plug comprises pressurizing the tubular.

13. The method of claim 10, further comprising landing the bottom plug in the landing collar, wherein the landing collar is coupled to a landing collar sleeve.

14. The method of claim 13, further comprising landing the landing collar onto the float collar, wherein the float collar comprises a valve.

15. The method of claim 13, further comprising increasing a pressure on the landing collar, wherein the bottom plug is sealed against an internal seat of the landing collar.

16. The method of claim 15, further comprising shearing one or more shear pins coupling the landing collar to the landing collar sleeve.

17. The method of claim 10, wherein the tubular has a diameter less than 5.5 inches.

18. The method of claim 10, wherein the second dart lands in a sleeve, wherein the sleeve translates and seats against a collar coupled to a top plug mandrel of the top plug, wherein the second dart creates a seal in an interior of the top plug.

19. The method of claim 18, further comprising increasing a pressure on the second dart to dislodge the top plug from a connector.

20. The method of claim 10, further comprising landing the top plug onto a landing collar sleeve, wherein a plurality of second fins creates a seal against an interior of the tubular.

* * * * *